US007891418B2

(12) United States Patent
Begnaud et al.

(10) Patent No.: US 7,891,418 B2
(45) Date of Patent: Feb. 22, 2011

(54) SLIPPAGE SENSOR AND METHOD OF OPERATING AN INTEGRATED POWER TONG AND BACK-UP TONG

(75) Inventors: Brian David Begnaud, Yongsville, LA (US); Mark Stephen Sebille, Lafayette, LA (US)

(73) Assignee: Frank's Casing Crew & Rental Tools, Inc., Lafayette, LA (US)

( * ) Notice: Subject to any disclaimer, the term of this patent is extended or adjusted under 35 U.S.C. 154(b) by 242 days.

(21) Appl. No.: 11/942,824

(22) Filed: Nov. 20, 2007

(65) Prior Publication Data

US 2009/0126536 A1 May 21, 2009

(51) Int. Cl.
*E21B 19/16* (2006.01)

(52) U.S. Cl. ..... 166/77.51; 166/85.1; 81/57.34

(58) Field of Classification Search ..... 166/77.51, 166/85.1; 81/57.34, 57.36, 57.44
See application file for complete search history.

(56) References Cited

U.S. PATENT DOCUMENTS

| | | | | |
|---|---|---|---|---|
| 5,099,725 | A | 3/1992 | Bouligny, Jr. et al. | |
| 5,664,310 | A | 9/1997 | Penisson | |
| 6,142,041 | A | 11/2000 | Buck | |
| 6,263,763 | B1 | 7/2001 | Feigel, Jr. et al. | |
| 6,318,214 | B1 * | 11/2001 | Buck | 81/57.35 |
| 6,334,376 | B1 | 1/2002 | Torres | |
| 7,163,335 | B2 * | 1/2007 | Dishaw et al. | 374/4 |
| 2003/0140736 | A1 * | 7/2003 | Buck | 81/57.35 |
| 2007/0079671 | A1 * | 4/2007 | Halse | 81/57.16 |
| 2008/0060481 | A1 * | 3/2008 | Hunter | 81/57.11 |
| 2008/0307930 | A1 * | 12/2008 | Veverica et al. | 81/57.34 |
| 2009/0211405 | A1 * | 8/2009 | Hunter et al. | 81/57.16 |

FOREIGN PATENT DOCUMENTS

| | | |
|---|---|---|
| EP | 0664272 A2 | 7/1995 |

OTHER PUBLICATIONS

PCT Int'l appl. No. PCT/US08/082822 "International Search Report and Written Opinion", Mar. 17, 2009, 12 pgs.

PCT/US2008/082822, "PCT International Preliminary Report on Patentability", date Jun. 3, 2010, 7 pages.

(Continued)

*Primary Examiner*—Daniel P Stephenson
(74) *Attorney, Agent, or Firm*—Patrick K. Steele; Streets & Steele

(57) ABSTRACT

Method and apparatus to make-up or break-out a threaded tubular connection using an integrated power tong and back-up tong (10). The power tong (20) may be disabled upon sensing a predetermined threshold amount of displacement of at least a portion of a back-up tong (14). The sensed displacement indicates that the back-up tong (14) is slipping, and power tong (20) rotation may be disabled to prevent damage to the pipe string (16) or surrounding equipment. A slippage sensor (40) may be disposed to sense displacement of at least a portion of the back-up tong (14) relative to a supporting frame (12). In one embodiment, the slippage sensor (40) may be operatively coupled to a valve (50) disposed in communication with a fluid line (46) supplying power fluid to the power tong (20). The power tong (20) may be disabled by impairing flow to the power tong (20) upon sensing a predetermined displacement of the back-up tong (14).

56 Claims, 9 Drawing Sheets

OTHER PUBLICATIONS

Best By Farr(TM) "Scissorlift Assembly Interchangeable 14"-50K & 22"-80K, Tong/Backup/Suspension Assemblies, Technical Manual", Farr Canada, A Division of McCoy Corporation, (The device is illustrated on pp. 26 (item #31), 28 (item #31), and 42 (Item #23), and mentioned on pp. 21 (section viii) and 43 (line item 23).) 327 pages (sent in 4 sets—set 1 pp. i-3.12, set 2 pp. 3.13-6.61, set 3 pp. 6.62-6.126, set 4 pp. 6.127-8.57), Jun. 2008.

* cited by examiner

SLIPPAGE SENSOR AND METHOD OF OPERATING AN INTEGRATED POWER TONG AND BACK-UP TONG

BACKGROUND

1. Field of the Invention

The present invention relates to methods and apparatus to operate an integrated power tong and back-up tong to make-up and run tubular strings into a drilled borehole.

2. Background of the Related Art

Oil field tubular members, e.g., drill pipe, production tubing and casing, are produced in segments that are coupled with threaded connections at their ends to form tubular strings. It is common to make-up and break-out threaded connections by gripping a first tubular segment and by gripping and rotating an adjacent, second tubular segment relative to the first tubular segment. The two adjacent tubular segments are typically gripped by separate tongs having mechanically, hydraulically or pneumatically-powered jaws that engage the exterior surfaces of the adjacent tubular segments. To achieve relative rotation of the tubular segments to make-up a connection, it is only necessary to rotate one of the two tubular segments using a power tong while holding the other tubular segment generally stationary using a back-up tong. Accordingly, the same two tongs (the power tong and the back-up tong) may be used to make-up or break-out a threaded connection between adjacent tubulars by reversing the rotational direction of the power tong. In this manner, a tubular string may be made-up and extended into the borehole by sequentially connecting and advancing add-on tubular segments, or a tubular string may be tripped out of the borehole by sequentially removing tubular segments from the tubular string.

While it is possible to make-up or break-out a threaded connection by gripping adjacent tubular segments with separate tongs and rotating the body of one or both tongs, this is not common practice due to various safety, spatial and design issues. Rather, common practice includes the use of a power tong having gripping jaws that rotate within the body of the tong. Therefore, the make-up and break-out of a connection can occur without significant swinging motions or significant lateral displacement of either tong.

On a drilling rig, a back-up tong is generally positioned to grip a portion of the tubular string that extends just above the spider, but just below a box end of the uppermost (first) tubular segment that extends through and is grippable by the spider. The power tong is generally positioned above and generally aligned with the back-up tong to grip an adjacent second tubular segment having a downwardly disposed pin end inserted in the box end of the first tubular segment extending through the spider. If the pin end of second tubular segment has been stabbed into the box end of the first segment in preparation to make-up the threaded connection, then the jaws of the power tong are rotated until the connection has been threadably made up. The jaws can be rotated in the direction to "make-up," or tighten, the connection until reaching a predetermined position or a threshold amount of torque, or a combination thereof. However, if the tubular string is being tripped out of the borehole, then the jaws of the power tong can be rotated in the direction to "break-out," or unthread, the connection until the uppermost tubular segment of the tubular string is threadably disconnected. It should be clear that the direction of rotation to make-up or break-out a tubular segment depends on whether the threaded connection includes right-handed or left-handed threads.

Reaction forces are forces that result from the application of torque to a tubular segment. For example, if the power tong grips and applies torque to a tubular segment in order to threadably connect the tubular segment to a tubular string that is suspended within a spider, then there will be an equal and opposite torque applied to the power tong. Similarly, as the threaded connection tightens and resistance to further rotation of the tubular segment increases, there will be an increasing amount of torque applied to the suspended tubular string that must be opposed by the back-up tong. In order to secure the back-up tong and power tong against unwanted movement resulting from the reaction forces, it is well-known to secure a snub line between a distal end of each of the tongs and some generally robust structural member of the rig, such as a snubbing post. For example, during a make-up operation involving a suspended tubular string and an adjacent tubular segment, each with standard, right-handed box and pin threads, respectively, the tubular string and the back-up tong that grips the tubular string react and are subjected to clockwise torque applied through the threaded connection by the power tong. Similarly, the power tong is subjected to a force that is equal to and opposite in direction to (counterclockwise) the torque applied to the tubular segment. A snub line to anchor the back-up tong would ordinarily be secured along a line generally tangent to an imaginary circle centered about the axis of the tubular string in order to oppose unwanted rotation of the tubular string or unwanted displacement of the back-up tong. Conversely, the jaws of the power tong bias the adjacent tubular segment to rotate in a clockwise direction to make-up the connection, and a snub line to anchor the power tong would ordinarily be secured to the distal end of the power tong to oppose unwanted displacement of the power tong. While effective, the use of snub lines presents certain hazards and constrains operations and personnel movement on the rig floor, and a solution to this problem has been developed.

An integrated tong system includes a power tong and a back-up tong. An integrated tong system applies, for example, a counterclockwise torque via the back-up tong to oppose a clockwise torque being applied via the power tong by directly coupling the power tong and back-up tong via a structural member referred to generally as a "reaction bar." The use of a reaction bar to directly react the power tong to the back-up tong generally negates the need to use snub lines and snub posts to provide these reactive forces. Accordingly, an integrated power tong and back-up tong system avoids much of the hazards and constraints of snub lines.

However, an integrated tong system may still cause damage by unwanted displacement of the integrated tong system about the tubular string if the jaws of the back-up tong slip or otherwise lose the grip on the tubular string under the high torque being applied by the power tong to an adjacent tubular segment during make-up or break-out of a threaded connection. If the back-up tong slips under these circumstances, the integrated power tong and back-up tong will begin to rotate counterclockwise about the tubular string. A safety line may be rigged to the system in the same fashion as is used for traditional snub lines to limit tong movement, but the sudden and unexpected motion can lead to damage of equipment.

Accordingly, what is needed is a method and apparatus that avoids damage as resulting from slippage between the tubular string and a back-up tong of an integrated tong system. It would be desirable if one embodiment of the method and apparatus includes minimal adaptation of an existing integrated tong system design.

SUMMARY OF THE INVENTION

An embodiment of the present invention provides an apparatus and a method to make-up and/or break-out a threaded connection between a suspended tubular string and an adjacent tubular segment with an integrated power tong and back-up tong system. An embodiment of the method comprises automatically disabling operation of the power tong in response to sensing greater than a predetermined threshold amount of lateral or rotational displacement of a portion of the back-up tong relative to the power tong or to a frame that supports the power tong. This embodiment of the method prevents damage to the integrated tong system and the tubular string gripped by the back-up tong that can otherwise be caused by slippage of the back-up tong during the process of making up or breaking out a threaded tubular connection. In one embodiment, the predetermined threshold amount of displacement is less than the amount of displacement that would allow the back-up tong to contact or damage a frame supporting the power tong and back-up tong components of the integrated tong system. The displacement due to slippage of the back-up tong on the suspended tubular string may be sensed with a sensor selected from the group consisting of a mechanical sensor, electromagnetic sensor, hydraulic sensor, pneumatic sensor, optical sensor, and combinations thereof. In one embodiment, lateral displacement of the back-up tong is sensed in a portion of the back-up tong that is positioned distal of the tubular gripping portion of the back-up tong, improving the effective sensitivity or resolution of the sensing device.

After sufficient displacement of the distal portion of the back-up tong has been sensed, the embodiment of the method may further comprise ceasing operation of the power tong. The system used to implement the method may further disengage the power tong jaws from the adjacent tubular segment, disengage the back-up tong jaws from the suspended tubular string, and allow the power tong and the back-up tong to stabilize and realign within the frame. Following sufficient realignment, the method may continue by re-engaging the back-up tong jaws about the suspended tubular string, and re-engaging the power tong jaws about the adjacent tubular segment. Operation of the power tong jaw may be enabled after the power tong and the back-up tong are realigned relative to or within the supporting frame. It should be understood that the term "frame" as used in connection with the structure that supports the components of the integrated tong system operated using the present invention may include one or more rods, beams, posts, cables, or other structural members to support, suspend, position or align the power tong or the back-up tong, one relative to the other.

To achieve steady operation, it may be desirable to restore alignment of the power tong and the back-up tong beyond the threshold condition at which disengagement or deactivation occurred. This approach will avoid reengagement of the power tong with the integrated tong system in a condition that is close to the amount of misalignment that might result in a subsequent disengagement. Optionally, the sufficient amount of realignment of the power tong or the back-up tong within the frame may be confirmed by sensing that the displacement of the monitored portion of the back-up tong, relative to the power tong or to a frame supporting the power tong, is less than the predetermined threshold amount or, alternatively, less than a predetermined re-enabling amount that is less than the predetermined threshold (disabling) amount that prompted the system to disengage the power tong.

In one embodiment, the rotation of the tubular segment by the power tong is automatically disabled by relieving the pressure in a pneumatic or hydraulic line that powers motors to rotate the jaws of the power tong. Optionally, the power tong jaws may also be disengaged from the tubular segment. In a power tong with the camming engagement of gripping jaws and then rotation of the gripping jaws being sequentially produced by movement of a single component, such as a rotary gear, one embodiment of the step of disabling operation of the power tong jaws may also serve to disable engagement of the power tong jaws from the tubular segment. In an alternate embodiment, the present invention may comprise a step of ceasing rotation by the power tong, and then breaking the gripping jaws loose from the tubular segment to facilitate restoration of the integral tong system to a generally aligned condition for reengagement.

An embodiment of the apparatus of the present invention may include an apparatus comprising an integrated tong system containing a power tong and back-up tong supported by or within a frame and including a fluid power line (e.g., pneumatic or hydraulic power line) coupled to the power tong, a slippage sensor disposed to sense displacement of the back-up tong relative to the power tong or the frame that supports the power tong, and a valve to relieve, redirect, limit or block fluid flow that is disposed in communication with the fluid power line and operatively coupled to the slippage sensor to impair flow, for example, but not by way of limitation, to relieve pressure, redirect flow, limit pressure or block or partially block flow, in the (pneumatic or) hydraulic fluid power line in response to sensing a predetermined threshold amount of displacement of a portion of the back-up tong. For example, but not by way of limitation, a pressure relief valve may be placed in communication with the hydraulic fluid supply line to a hydraulic motor powered tong such that displacement of the back-up tong exceeding a predetermined threshold amount of displacement impairs the flow of hydraulic fluid to the power tong by opening the valve to relieve the hydraulic pressure from the supply line and to thereby substantially disable the motor of the power tong. In one embodiment, the slippage sensor allows less than the predetermined threshold amount of displacement without operating the pressure relief valve. In one embodiment, the predetermined threshold amount of displacement is less than the amount of displacement that would cause the back-up tong to contact any portion of the frame supporting the back-up tong component.

Typically, a power tong is coupled to a back-up tong by a reaction system that uses the reaction torque on the power tong as torque is applied to the tubular segment to offset and generally balance against reaction torque in the back-up tong that holds the tubular string. In an alternate embodiment, the slippage sensor may be secured to the power tong or to the reaction system that couples the power tong to the back-up tong, and the slippage sensor may detect slippage of the back-up tong by sensing related movement of the power tong or movement of some component(s) of the reaction system that results from slippage of the back-up tong. This alternate embodiment may be applied to integrated tong systems that include a top or laterally supported frame from which the power tong and back-up tong are suspended, as opposed to a more conventional tong system suspended within a frame that is supported from the rig floor or other structure underneath the frame.

It should be understood, however, that the use herein of the word "suspended" in referring to the power tong and back-up tong includes any supportive arrangement wherein the power tong and the back-up tong are supported in a generally aligned relationship, one relative to the other, to facilitate the gripping of two generally aligned tubular members to make-up or break-out a threaded connection between the two tubulars. Either the power tong or the back-up tong, or both, may be suspended from or in a position within or relative to a frame member using cables, cylinders, flexible couplings, rails, rollers, cams, guides or the like, so long as the supporting components are arranged to allow at least some movement of the back-up tong relative to the power tong upon slippage of the grip of the back-up tong on the tubular string. It should be further understood that the power tong or the back-up tong may be supported in a manner that causes them to project from, or hang from, a supportive frame member, and a frame member need not be a surrounding structure to provide support to the power tong or the back-up tong. It should be further understood that the power tong or the back-up tong, or both, may comprise two or more components that cooperate to engage and grip the tubular members. For example, but not by way of limitation, the power tong may comprise two separate members, one to impart rotation to the tubular segment in a first direction, and the other to impart rotation to the tubular segment in a second, opposite direction, to facilitate make-up and break-out rotation, respectively.

It should further be understood that the frame members used to suspend the power tong or the back-up tong, or both, may be movable on or above the rig floor and in the general vicinity of the tubular string using various structures. For example, but not by way of limitation, the power tong and the back-up tong may be suspended within a frame member that is slidably or rollably supported on a rig floor and adapted to facilitate movement of the power tong and the make-up tong to and from well center. A frame member may also be supported from the derrick of the rig, or from adjacent structural members that are supported by the derrick or the rig floor. Those skilled in the art will appreciate that two or more frame components may be used to structure a frame member to support the power tong and the back-up tong, and that coupling these frame components together to form and function as a frame member is within the scope of the present invention.

In one embodiment, the slippage sensor includes a mechanical coupling having a first end secured to the back-up tong and a second end secured to the frame of the integral tong system. For example, the mechanical coupling may include a joint to accommodate limited displacement of the back-up tong into alignment and gripping engagement with a tubular string without operating the pressure relief valve. Optionally, the mechanical coupling may include a spherical joint to accommodate three dimensional displacement of the back-up tong without binding or breaking the slippage sensor. The slippage sensor includes, without limitation, a sensor of a type selected from mechanical, electromechanical, electromagnetic, pneumatic, hydraulic, optical, and combinations thereof.

The foregoing and other objects, features and advantages of the invention will be apparent from the following more particular description of one embodiment of the invention, as illustrated in the accompanying drawing wherein like reference numbers represent like parts of the invention.

DETAILED DESCRIPTION OF AN EMBODIMENT

Figure 1:
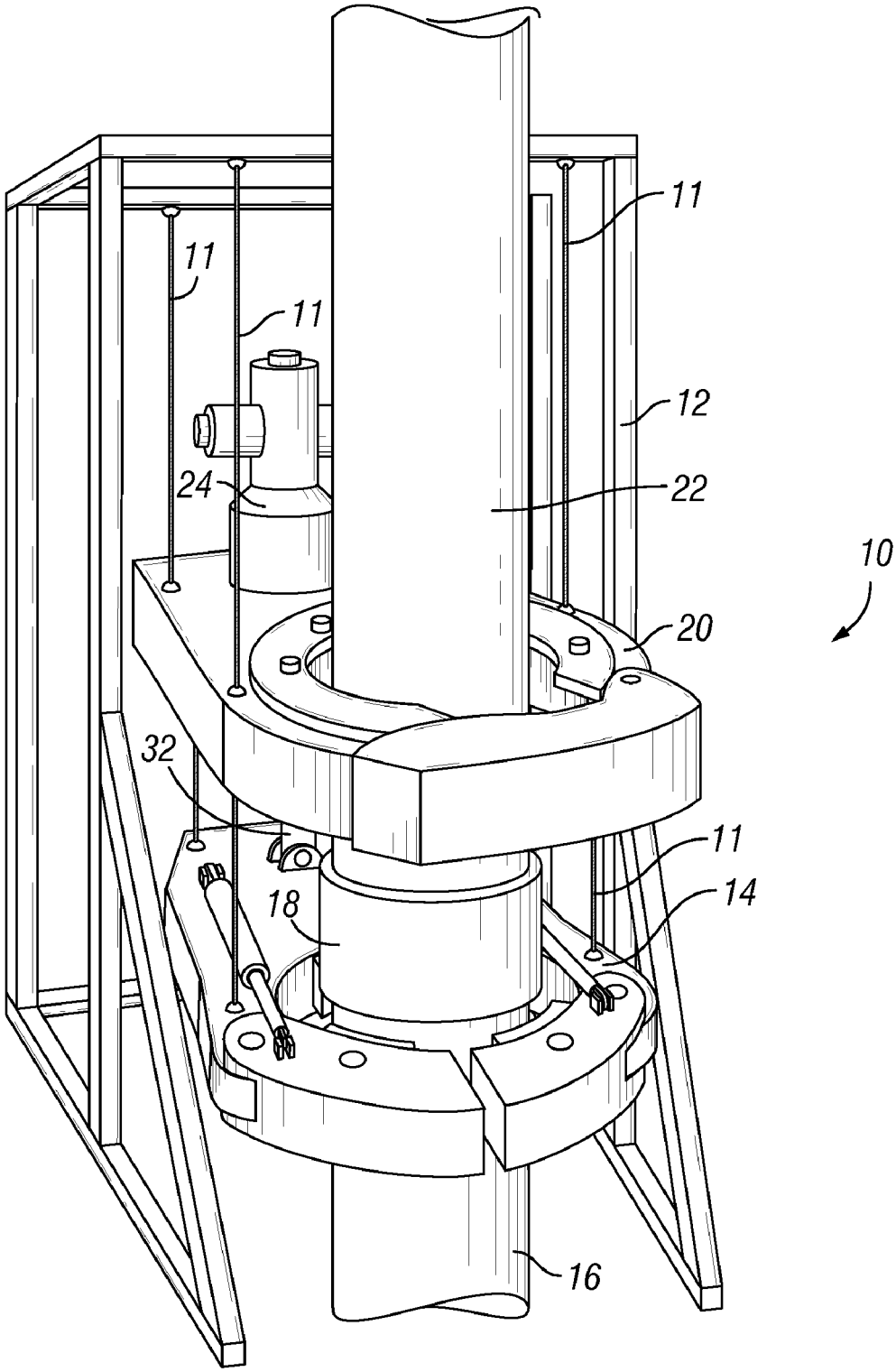
FIG. 1 is a perspective view of an integrated tong system comprising a frame that supports both a power tong and a back-up tong, and is positioned on a rig floor to make-up a threaded connection between a tubular string and a tubular segment.

The present invention provides a method and apparatus to make-up and/or break-out a tubular connection using an integrated power tong system. An embodiment of the method includes the step of automatically disabling operation of the power tong component in response to sensing greater than a predetermined threshold amount of lateral displacement of a portion of the back-up tong. Disabling operation of the power tong in this manner may prevent damage to the integrated power tong system or surrounding equipment if the jaws of the back-up tong were to slip relative to the tubular string gripped by the back-up tong. Furthermore, the early detection of slipping between the back-up tong and the tubular string can enables prompt and automatic remedial actions so that make-up or break-out operations can proceed expeditiously.

An embodiment of the apparatus may include an integrated tong system comprised of a frame, a power tong and a back-up tong, and can includes a pneumatic or a hydraulic fluid power line coupled to the power tong. For purpose of this disclosure, reference will be made to an exemplary embodiment having a hydraulically-powered power tong. A slippage sensor is disposed to sense displacement of the back-up tong relative to the frame. A slippage sensor can be operatively coupled to a hydraulic pressure relief valve disposed in the hydraulic power fluid line of the power tong (e.g., in series) to relieve pressure in the hydraulic power fluid line in response to sensing greater than a predetermined displacement of the back-up tong.

The slippage sensor may include devices that are capable of determining that the back-up tong has moved in a manner consistent with the back-up tong jaws slipping about the tubular string during a make-up or break-out operation. Because the gripping jaws of the back-up tong are secured about the tubular string, movement of the body of the back-up tong during make-up or break-out operations is generally constrained to rotation about the axis of the tubular string, which extends through the tubular string suspending device, such as a spider. A slippage sensor can be most sensitive to unwanted rotation of the back-up tong if it is disposed to sense displacement of a portion of the back-up tong that is the greatest distance from the tubular string, such as the distal portion of the body of the back-up tong. In one embodiment, by sensing displacement of a distal portion of the back-up tong, angular rotation or displacement of the back-up tong will cause a lateral displacement of a magnitude that can be reliably sensed. In one embodiment, the magnitude of the lateral displacement that is sensed is large enough to avoid false detection, yet small enough to enable the slippage sensor to reliably operate and avoid damage to the frame and other equipment.

A slippage sensor can be designed or positioned so as to have greater sensitivity to lateral displacement of the back-up tong than to vertical or radial displacement of the back-up tong. Some amount of radial displacement of the back-up tong can be desirable to allow the back-up tong to align with the tubular string as the jaws close on, engage and grip the tubular string. Similarly, some amount of vertical displacement can also occur without indicating that the jaws have slipped. The term "lateral displacement," as used herein, shall mean all rotational and translational movements directed toward the side or in a generally horizontal (relative to the axis of the tubular segments being connected) direction in an arc around the tubular string. While the actual displacement of the back-up tong may include vertical and/or radial components of movement, it is the lateral or rotational component of the displacement that is primarily to be sensed. Therefore, the slippage sensor may be suitable to sense displacements other than in the lateral direction, and may be suitable to sense lateral displacement notwithstanding displacements other than lateral displacement, such as vertical and/or radial displacement.

Furthermore, the apparatus of the present invention can sense lateral displacement through the use of any type of device, such as mechanical, electrical electromechanical, electromagnetic, hydraulic, pneumatic, and optical devices. For example, the slippage sensor may include a mechanical coupling having a first end secured to the back-up tong and a second end secured to the frame. Such a mechanical coupling can include a coupling or a joint to accommodate some radial displacement of the back-up tong, such as may occur when the back-up tong is brought into alignment with a tubular string, without causing the valve to impair flow to the power tong. For example, a spherical joint can be particularly useful to accommodate three-dimensional displacement of the back-up tong, while communicating with a sensor that senses primarily the lateral component of the displacement.

In one embodiment, a slippage sensor may include a mechanical coupling of the tong and frame, but the actual sensor that senses lateral displacement may be independently selected. Non-limiting examples of suitable sensors includes mechanical, electrical, electromagnetic, pneumatic, hydraulic, and optical sensors. In embodiments having a sensor that produces a physical response, it is possible to directly actuate a valve that disables the power tong. A physical sensor can include the advantages of improved durability and reliability due to the presence of fewer components that may fail to impair or disable the slippage sensor. Embodiments employing a sensor that produces an electronic and/or illuminated signal will can include a separate actuator and/or source of motive power to actuate the "relief valve" to, for example, interrupt or complete an electrical conducting pathway and/or a light conducting pathway. Electrically conducting pathways, such as wires, are widely known. A light conducting pathway, such as an optical fiber, may be interrupted by severing a sacrificial optical fiber, or by misaligning a fiber optic connector, for example. Similarly, a light conducting pathway may be completed by aligning a fiber optic connector to energize an actuator. While these types of sensors may implicate a more complicated control system, the electronic and/or optic signal can be utilized to take further safety measures or achieve further automation of the make-up and break-out process including indication of status to operators and/or one or more automation control systems operating equipment in related operations.

The method and apparatus of the invention may utilize one sensor or more than one sensor. Slipping of the back-up tong can manifest itself in lateral displacement in a counter-clockwise (assuming threaded connections are right-handed) direction during make-up and in a clockwise direction during break-out. Accordingly, it would be possible to implement one sensor to sense lateral displacement in either direction. However, as will be described in reference to the embodiment in FIG. 4, a single sensor may perform both jobs by cooperating with a suitable mechanical coupling. Furthermore, the invention could be achieved using one or more sensors to incrementally or continuously sense or quantify lateral displacement of the back-up tong in either or both directions away from the tong's aligned position within the frame.

In a described embodiment, during a make-up or break-out operation, sensing that the back-up tong has slipped an amount beyond the tolerated amount will automatically disable the power tong. In order to continue the make-up or break-out operation, it is necessary to reset and align the back-up tong and the power tong, and to then enable the power tong. The jaws of the disabled power tong may disengage from the tubular segment, or at least loosen their grip on the tubular segment. However, it may also be necessary to release pressure on the back-up tong jaws before the back-up tong and the power tong components of the integrated tong can stabilize and align within the frame. The power tong and the back-up tong components of the integrated tong system can be caused to align under their own weight by virtue of geometry of the hangers or struts that may support the integrated tong system components within the frame. Specifically, this realignment can be accomplished if the hangers are of suitable length and attachment positions located so that gravity biases the integrated tong components to return to their aligned positions within the frame unless acted upon by a substantial outside force. The aligned positions will typically be laterally central positions within the frame of the integrated tong. The gripping jaws of either or both of the power tong and back-up tong components could be affirmatively retracted from engagement with the tubulars through appropriate biasing of the control system(s), or by manual intervention.

Following back-up tong slippage, the power tong can be disengaged from gripping or rotating the tubular string until satisfactory alignment of the power tong and back-up tong components has been achieved. A slippage sensor or a separate sensor can be utilized to further indicate that the back-up tong or the power tong components of the integral tong system, or both, are sufficiently aligned one with the other, or either or both with the tubulars or the frame, for operations to recommence. For example, the slippage sensor might simply indicate that the back-up tong component of the integral tong is no longer laterally displaced greater than the predetermined threshold amount of lateral displacement to cause interruption of operations. In one embodiment, the power tong is not re-enabled until one or both of the back-up tong and the power tong are determined as having been substantially fully aligned. Presumably, the power tong and back-up tong components will align as a unit, and it is not necessary to detect both tongs separately, although separate detection is certainly within the scope of the invention. It should be noted that, while biasing members and self-restoring structures may be used to automatically realign components of the tong system, automatic restoration of the tong system to an operable state is not required.

Once the integrated tong is aligned within the frame, and the power tong and back-up tong components are both enabled, the make-up or break-out operation may continue. So long as the back-up tong is not laterally displaced due to slipping, the make-up or break-out operations are performed in their usual and well-known manner.

The appended drawings represent specific embodiments of the present invention and should not be interpreted as limiting the scope of the invention that is set out in the claims. The discussion of the drawings discussed below is intended to provide a full disclosure of a working embodiment of the invention. Upon considering the present application and drawings, it will become apparent to those having ordinary skill in the art that the invention may be implemented through other embodiments. It should be recognized that these other embodiments are within the scope of the invention.

FIG. 1 is a perspective view of an integrated tong system 10 having a back-up tong 14 and a power tong 20 supported by hangers, cables or chains 11 from a frame 12 and positionable on a rig floor to make-up a threaded connection between a tubular string 16 and a tubular segment 22. The back-up tong 14 grips the tubular string 16 at a portion of the tubular string protruding above a pipe suspending device, such as a spider (not shown) and below a threaded connection, such as a box end 18 of the tubular string that is the uppermost portion of the tubular string extending downwardly into the borehole. A power tong 20 grips the adjacent tubular segment 22 (i.e., an "add-on" tubular segment in a make-up operation) just above the downwardly disposed threaded connection, such as a pin end, of that tubular segment. Both the back-up tong 14 and the power tong 20 can include moveable gripping jaws (not shown), e.g., hydraulically-powered jaws. Depicted power tong 20 includes a motor 24 that powers a drive gear (not shown) to rotate the power tong. Specific details of the construction of the gripping and rotating components of a power tong are well-known within the art of threaded oilfield tubular connections.

Figure 2:
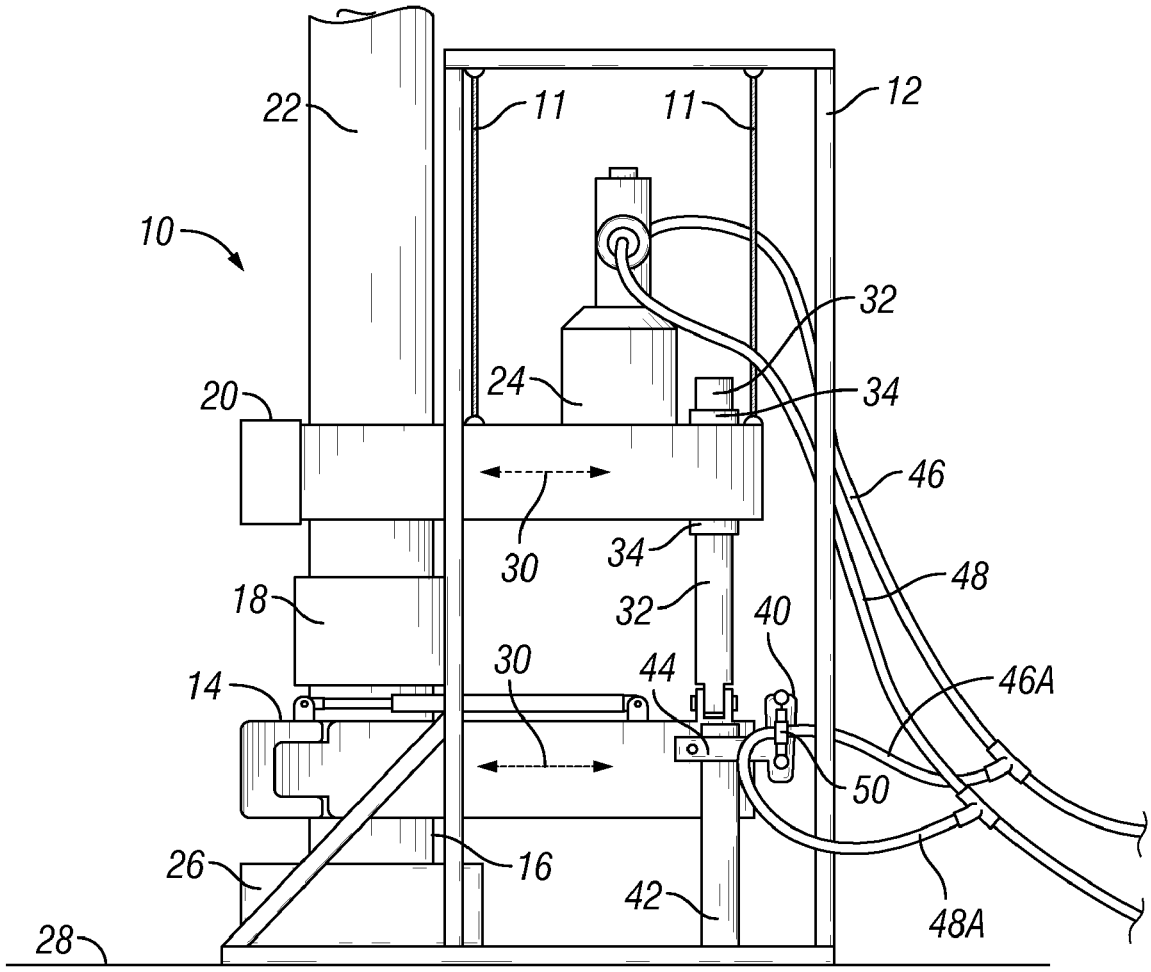
FIG. 2 is a side view of the integrated tong system of FIG. 1, including an exemplary hydraulic system to automatically disable the power tong component of the integrated tong system.

FIG. 2 is a side elevation view of the integrated tong system 10 comprising a frame 12 of FIG. 1, including an exemplary system to automatically disable the power tong. The tubular string 16 extends through a pipe suspending device, such as a spider 26, on or received within the rig floor 28 and into the borehole (not shown). The position of the spider 26 establishes the well-center where the gripping jaws of the integrated tong system 10 can be positioned for make-up and break-out operations. The frame 12 is positioned so that the jaws of the back-up tong 14 and power tong 20 are generally aligned with the spider 26, the tubular string 16, and with each other. Minor adjustments in the position of the back-up tong 14 or the power tong 20 in a radial direction 30 are accommodated by the hangers 11 that suspend the power tong 20 and back-up tong 14 components of the integrated tong system 10. Furthermore, adjustments in the vertical spacing of the power tong 20 and the back-up tong 14 are accommodated by a reaction bar or shaft 32 and bushing 34. A slippage sensor 40 in accordance with one embodiment of the invention is shown positioned at an end of the back-up tong 14 that is distal from the gripping jaws of the back-up tong that engage the tubular string 16. One end of the sensor 40 is secured to a frame member 42 by a bracket 44.

One embodiment of the present invention involves the step of sensing a condition that may be alleviated, in one aspect, by suspending make-up or break-out operations, and then the step of disabling the motor 24 to suspend operations until the condition can be remedied. Although a number of configurations could be utilized to disable the power tong motor 24, FIG. 2 illustrates one embodiment of a pressure relief configuration. A hydraulic fluid power line 46 is in fluid communication between a source of hydraulic fluid, such as, but not limited to, a hydraulic pump (not shown), and the power tong motor 24. In the embodiment in FIG. 2, a hydraulic fluid return line 48 is provided to receive and return the depressurized hydraulic fluid exiting the motor 24 to a reservoir (not shown) positioned to feed suction to the pump. The slippage sensor 40 depicted includes a relief valve 50 that is fluidically coupled in parallel to the motor 24 through fluid lateral 46A. If the valve 50 is opened, the hydraulic pressure to the motor 24 is relieved through fluid lateral 46A and immediately and substantially reduced because the hydraulic fluid pressure source is thereby placed in direct fluid communication with the reservoir, which can be at or near ambient pressure. Accordingly, the power tong 20 of the illustrated embodiment is disabled by the opening of the relief valve 50.

Figure 3:
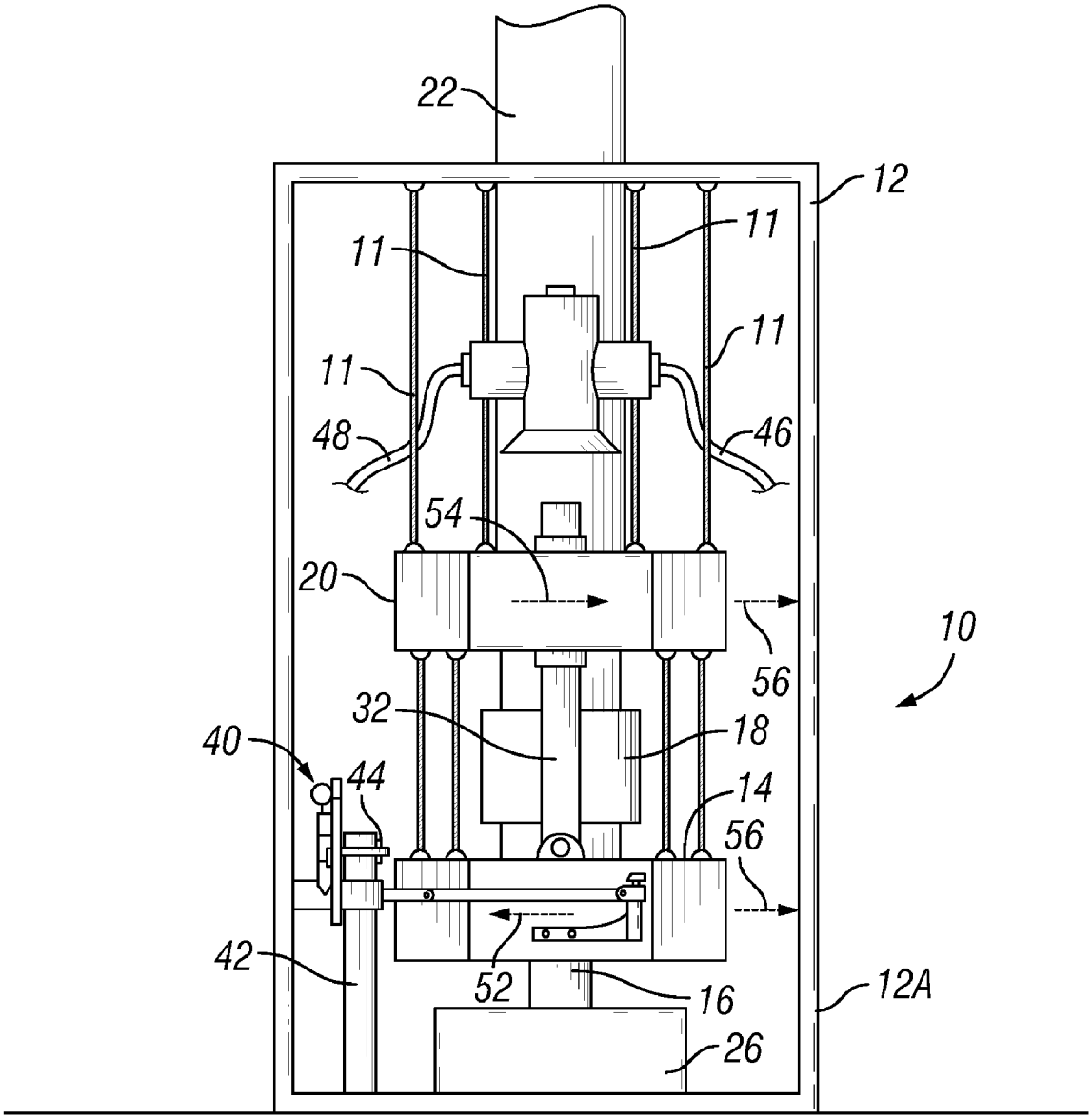
FIG. 3 is a rear view of the integrated tong system of FIG. 1-2 showing a slippage sensor secured between the back-up tong and the frame.

FIG. 3 is a rear view of the integrated tong system 10 of FIGS. 1-2 showing a slippage sensor 40 secured between the back-up tong 14 and the frame 12. One end of the slippage sensor 40 is rigidly connected to the frame member 42 with a bracket 44, and the other end of the slippage sensor is coupled to the distal end of the back-up tong 14. The hydraulic lines shown in FIG. 2 have been omitted from FIG. 3 to more clearly show the apparatus.

As seen in FIG. 3, the back-up tong 14 and power tong 20 are coupled one to the other by a reaction bar so that the shaft 32 transfers torque on the body of the power tong 20 against the torque on the body of the back-up tong 14. In one embodiment, the torque applied by the power tong 20 is generally equal in magnitude and opposite in direction to the torque on the back-up tong 14, so that the integrated power tong and back-up tong 10 is normally under zero or a very low net torque during tong operation and will maintain a relatively stable position, as shown. However, if the jaws of the back-up tong 14 depicted lose grip on the tubular string 16 and begin to slip, the back-up tong 14 no longer contributes an equal and opposite reaction torque to oppose all or most of the torque applied by the power tong 20. Accordingly, the integrated tong 10 is then subjected to a potentially destabilizing net torque, and may be displaced e.g., along the rig floor in the direction of that net applied torque. Since the threaded connections occur about a substantially vertical axis, the direction of that net torque is generally lateral and will include a large lateral component that can cause significant lateral displacement.

During the make-up of a threaded connection, the back-up tong 14 is subjected to clockwise torque (in the direction of arrow 52) and the power tong 20 is subjected to counterclockwise torque (in the direction of arrow 54). Therefore, slipping of the grip by the back-up tong 14 on the tubular string 16 during a make-up operation may cause the entire integrated tong system 10 to be displaced in the counterclockwise direction (in the direction of arrow 56). During break-out of a threaded connection, the torque directions and the potential displacement caused by unwanted back-up tong slippage is the opposite the direction described above for the make-up process. The foregoing discussion assumes the use of standard, right-handed threads that tighten by clockwise rotation, and describes rotational directions relative to the axis of the tubular string as viewed from above. It should be understood that the present invention is equally adaptable for use on tubular strings having left-handed threaded connections, and also for tubular strings made-up and run into a well using the "pin-up" method, as opposed to the "pin-down" method illustrated in the appended drawings.

Figure 4:
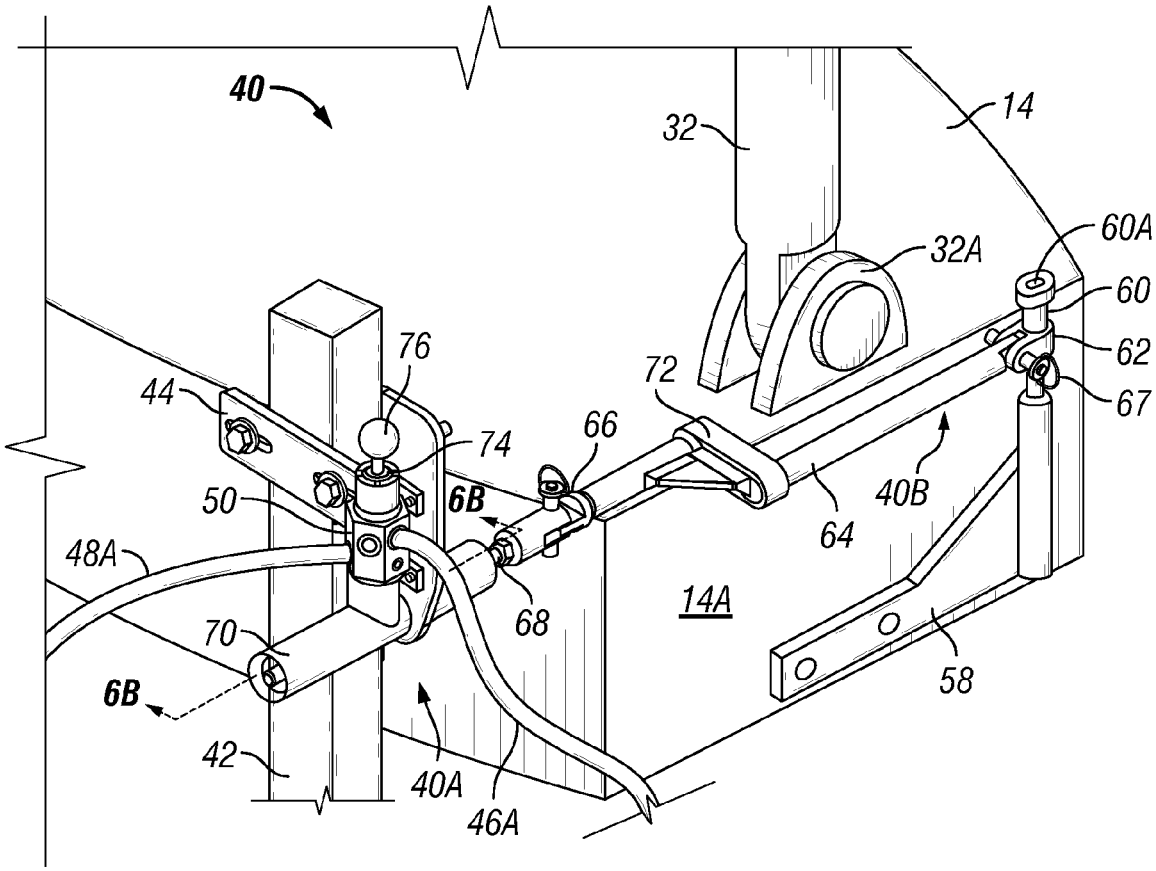
FIG. 4 is a perspective view of the slippage sensor secured between the back-up tong and a frame member.
Figure 5:
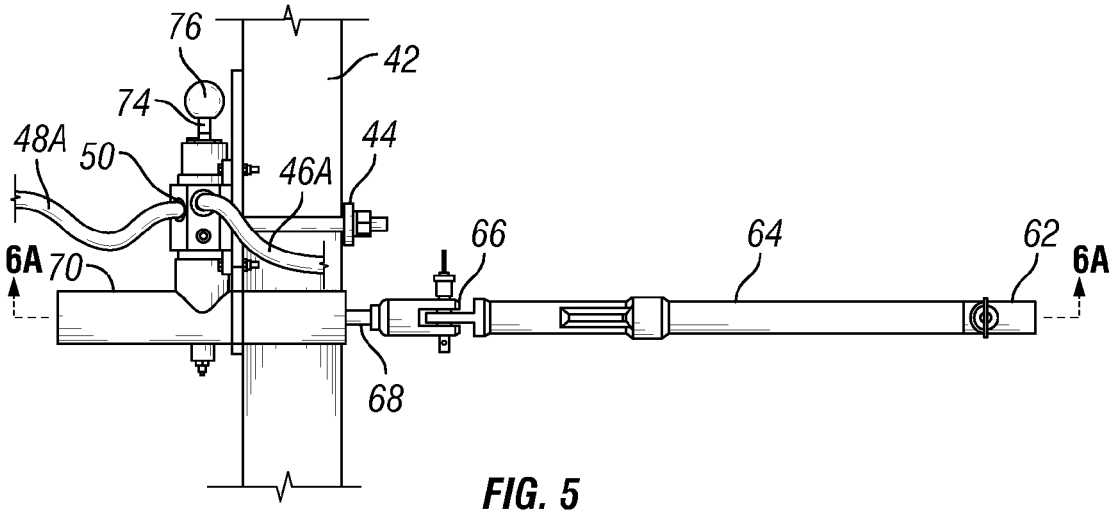
FIG. 5 is a side view of the slippage sensor of FIG. 3-4 illustrating the joint in the actuation arm.

FIGS. 4 and 5 are perspective and side elevation views, respectively, of one embodiment of a slippage sensor 40 secured between the distal end 14A of the back-up tong 14 and a frame member 42. A first end 40A of the slippage sensor 40 is depicted as rigidly secured to the frame member 42 using a bracket 44. A second end 40B of the sensor 40 is depicted as pivotally coupled to the distal end 14A of the back-up tong 14. The pivotal coupling at the distal end of the back-up tong may be implemented by securing a bracket 58 to the distal end 14A of the back-up tong 14 (see FIG. 4) with a vertical shaft 60 extending upwardly from the bracket 58. A slider clevis 62 may be slidably received onto the shaft 60 and secured thereon by use of a bolt 60A on the end of the shaft 60. A rigid connecting rod 64 may be pivotally coupled to the slider clevis 62 with a pin 67.

The rigid connecting rod 64 may have another pivotal coupling 66, such as an elbow, a spherical bearing, universal joint, or the like, securing it to a cam actuator rod 68 that extends into and/or is movable within the bore of a cylindrical actuator chamber 70. Because the chamber 70 in FIG. 4 is secured to the bracket 44 and the bracket is secured to the frame member 42, the axis of the chamber 70 and the cam actuator rod 68 is generally fixed relative to the frame (see elements 12 and 42 of FIG. 3) in a lateral direction generally toward the vertical shaft 60. Accordingly, a displacement of the distal end 14A of the back-up tong 14 causes a displacement of the slider clevis 62 that is substantially along the axis of the chamber 70 and the cam actuator rod 68. However, the connecting rod 64 can swing about an arcuate path centered at the pivot coupling 66 without causing substantial movement of the cam actuator rod 68 within the bore of the chamber 70. Accordingly, the length of the connecting rod 64 affects how much lateral displacement of the cam actuator rod 68 results from normal vertical or radial movements of the back-up tong 14 that may occur during operation of the integral tong system without slippage of the grip of the back-up tong 14 on the tubular string.

It should be understood that other structures may be used to trigger the slippage sensor in response to unwanted or excessive movement of the back-up tong 14 occurs. In one alternative embodiment, the slippage sensor may comprise a flexible tether. For example, and referring to FIG. 4A, a safety line comprising one or more flexible tethers 82 and 83, such as a rope (e.g., wire, rope, chain, etc.), may be used.

Figure 4A:
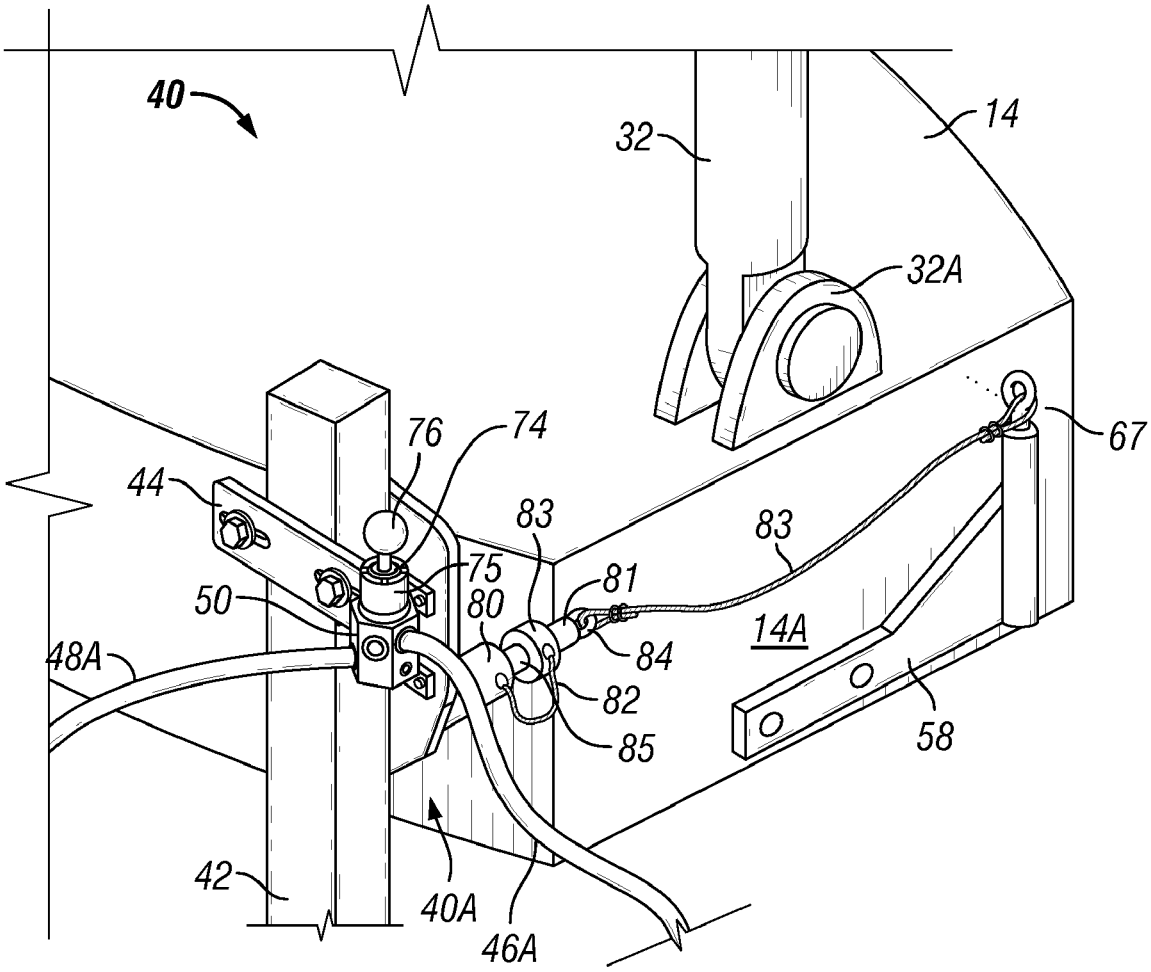
FIG. 4A shows a magnetic switch comprising switch body 80 and a cooperating magnetic cap 81 that is magnetically secured to the switch body 80 to dispose the switch in the closed position.
Figure 4B:
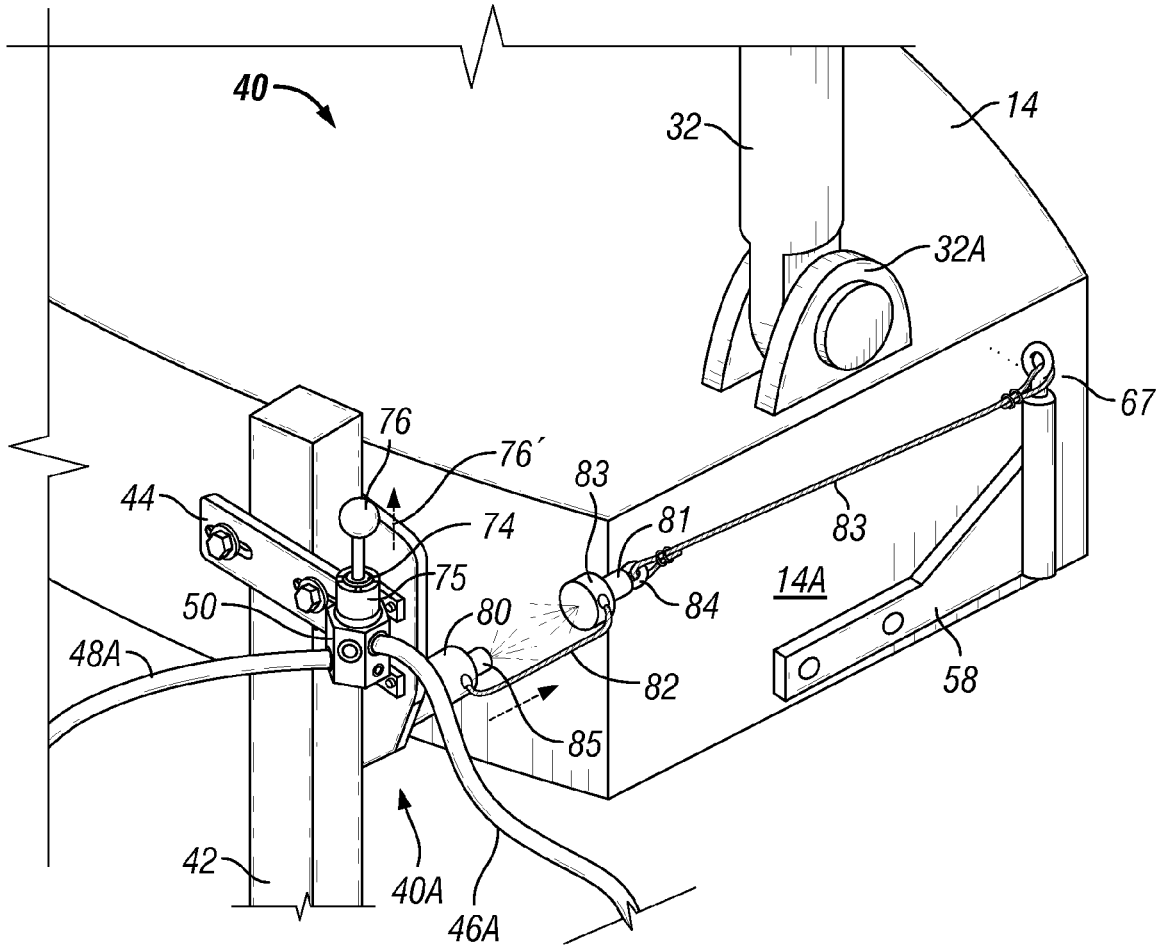
FIG. 4B illustrations the operation of the alternate embodiment of the slippage sensor 40 shown in FIG. 4A when the magnetic switch is triggered to open by unwanted movement of the distal portion 14A of the back-up tong 14 away from the magnetic switch.

FIGS. 4A and 4B depict one alternative embodiment of the slippage sensor in "before" and "after" configurations. FIG. 4A shows a magnetic switch comprising switch body 80 and a cooperating magnetic cap 81 that is magnetically secured to the switch body 80 to dispose the switch in the closed position. The switch body 80 may be an electrical switch coupled by a first tether 82 to the frame member 42, and the magnetic cap 81 may be coupled by a second tether to the back-up tong 14. The electrical switch is operable to close an electrical circuit when the magnetic cap 81 is in place and secured to the switch body 80, and to open the circuit when the magnetic cap 81 is removed from its position shown in FIG. 4A secured to the switch body 80 to bridge a conductor across two exposed contacts. When the electrical circuit is closed, a battery or other source of electrical power (not shown) that may be disposed within switch body 80 may provide a current flow through a coiled conductor (not shown) disposed within housing 75. The magnetic field generated by the flow of current through the coiled conductor in the housing 75 restrains the valve 50 in its closed position, and restrains valve stem 74 and the manual reset knob 76 in their closed positions, against a spring or other biasing member that may bias the valve 50, the valve stem 74 and the manual reset knob 76 all toward their open positions. It should be understood that a tether, as that term is used herein, may comprise a wire, rope, chain, cord, string, or other generally elongate member that may bear at least some amount of tensile load when coupled between to components that may move one relative to the other.

As shown in FIG. 4A, the first tether 82 and the second tether 83 may each have slack to hang freely between two each pair of couplings during normal operation of the integral power tong, i.e. when there is no slippage of the grip by the back-up tong 14. Upon slippage of the grip of the back-up tong 14 on the tubular string 16 (not shown in FIG. 4A—see FIG. 2), the resulting lateral movement of the back-up tong 14 and, more specifically, the resulting movement of the distal end 14A of the back-up tong 14 is in the direction of arrow 56 (assuming right-handed threads—see FIG. 3) and away from the frame member 42, and causes the couplings at the first end and the second end of the second tether 83 to become further separated and the slack to be removed from the second tether 83. After the tether 83 becomes taut, further movement of the back-up tong 14 from the frame member 42 imparts tension to the tether 83, and dislodges the magnetic cap 81.

FIG. 4B illustrations the operation of the alternate embodiment of the slippage sensor 40 shown in FIG. 4A when the magnetic switch is triggered to open by unwanted movement of the distal portion 14A of the back-up tong 14 away from the magnetic switch. The second tether 83 is pulled taut and detaches the magnetic cap 81 from the switch body 80. The removal of the magnetic cap 81 from the switch body 80 opens the electrical circuit and terminates the magnetic field that restrains the valve 50 in its closed position.

If the distal portion 14A of the back-up tong 14 moves further from the frame member 42 notwithstanding operation of the slippage sensor 40, then the first tether 82 may become taut between its couplings as shown in FIG. 4B to secure the distal portion 14A of the back-up tong 14 against further unwanted movement away from the frame member 42 (and in the direction of arrow 56 in FIG. 3).

It should be understood that other embodiments of a slippage sensor comprising a disabling element actuated by transfer of displacement to the disabling element through a tether are within the scope of this invention. The magnetically secured fuse element illustrated in the foregoing description is but one example of a fuse element that is disabled by transfer of displacement through a tether. For example, but not by way of limitation, a fuse element may comprise a pair of prongs received within a corresponding pair of slots to complete a circuit, e.g., like a conventional electrical plug and socket. Alternately, the valve may comprise a gate that is slidable between a closed position and an open position, and the tether that is coupled to the back-up tong at its second end may be coupled to the slidable gate at its first end so that a disabling amount of tension in the tether slides the gate from its closed position to its open position to impair flow of power fluid to the power tong and disable the power tong. It should be clear to those skilled in the art that a variety of linkages and/or mechanisms may be employed to translate movement of the back-up tong to an actuating force, through a rigid member that can translate by movement in either direction or a tether than translates movement only in tension, and that the use of other linkages and/or mechanisms to sense displacement of the back-up tong and use it to operate a valve to disable the power tong are within the scope of this invention. It should be further understood that the tether may be generally inelastic or elastic, and that the tether may slack when the valve is in its closed position, or it may remain under tension during normal operation where such tension does not exceed the disabling amount of tension necessary to operate the valve and disable the power tong absent a threshold amount of displacement of the back-up tong. It should be understood that, in an alternate embodiment, an electrically conducting wire could serve as a sacrificially failing tether for disabling the power tong.

Figure 6A:
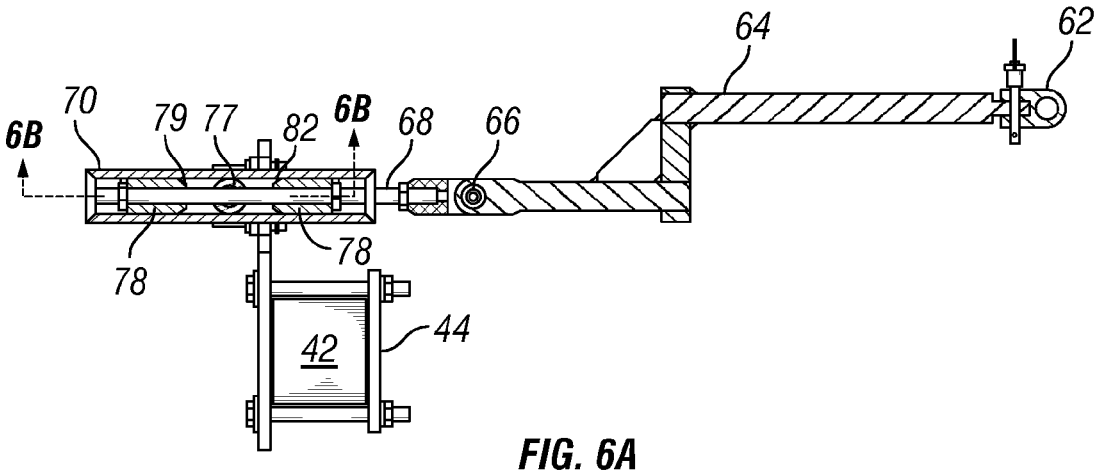
FIG. 6A is a horizontal cross-section view of the slippage sensor of FIGS. 3-5 taken along line 6A-6A in FIG. 5.

Returning to the embodiment shown in FIG. 4, where a rigid member is used to translate movement of the back-up tong 14 to the slippage sensor, a member may be shaped to accommodate any obstructions that may exist. As shown in FIG. 6A, a dog leg(s) 72 in the connecting rod 64 may be included to illustrate that the configuration of the connecting rod 64 may be manipulated to direct the connecting rod around obstructions presented by components of the integral tong system, such as the pivotal coupling 32A that couples the integrating shaft 32 to the distal end 14A of the back-up tong 14. The connecting rod 64 may be adapted to accommodate the obstacles without deterring the performance of the slippage sensor 40.

Returning to the embodiment in FIG. 4, a hydraulic valve 50 is mounted generally radially to the cylindrical actuator chamber 70 with a valve stem 74 having a first, upwardly disposed end having a manual reset handle 76 and a stem extending through the valve 50 to position a second, downwardly disposed end within the chamber 70. As will be described in greater detail with reference to FIGS. 6A and 6B, the second end of the valve stem 74 interacts with a cam on the cam actuator rod 68 to open the valve 50. With the valve 50 in the open condition, pressurized hydraulic fluid in line 46 can be relieved to line 48 to substantially relieve pressure in the line 46.

FIG. 6A is a cross sectional view of the slippage sensor 40 of FIGS. 3-5 taken along line 6A-6A in FIG. 5. The cylindrical actuator chamber 70 is shown receiving a portion of the cam actuator rod 68 having a pair of cams 78 thereon. As previously mentioned, the stem 74 (not shown in FIG. 6A-*see* FIG. 6B) of relief valve 50 includes a second end 77 that supports a follower 77A that extends into the bore of the chamber 70. When the cam actuator rod 68 is sufficiently displaced in either direction along the axis of the bore of the chamber 70, a cam surface 79 on one of the cams 78 will engage the follower 77A at the second end 77 of the valve stem and push the valve stem 74 radially outwardly from the bore of the chamber 70 in the direction of arrow 74'. Accordingly, lateral displacement of the cam actuator rod 68 resulting from lateral displacement of the distal end 14A of the back-up tong 14 is effective to open valve 50, resulting in a significant loss of fluid pressure in power fluid supply line 46 that disables the motor 24 of the power tong 20.

Depressing (e.g., manually) reset handle 76 after the back-up tong 14 has been realigned in the frame 12 can close the relief valve 50 and thereby re-enable the motor 42 of the power tong 20 for further make-up or break-out operations. Automatic actuation of the reset handle via springs and/or independent actuators may be employed and are within the scope of the invention.

Figure 6B:
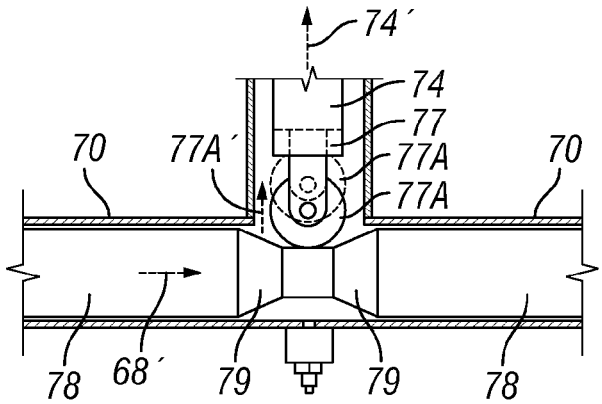
FIG. 6B is an enlarged vertical cross-section view of a portion of the slippage sensor of FIGS. 3-5 taken along the line 6B-6B in FIGS. 5 and 6B and showing details of the actuator chamber and the cam actuators of the cam actuator rod.

FIG. 6B is an enlarged cross-sectional view of a portion of the actuator chamber 70 and the cams 78 secured to the cam actuator rod 68. The illustrated cam surfaces 79, one of which is adjacent to each cam 78, are positioned to "straddle" the follower 77A coupled to the second end 77 of the valve stem 74. Sufficient displacement of the cam actuator rod 68 within the bore of the chamber 70 will cause one or the other of the cam surfaces 79 on the cam 78 depicted to engage and displace the follower 77A and the valve stem 74 in the direction of arrow 74' and generally radially away from the cam actuator rod 68 to open the valve 50 and relieve hydraulic pressure to disable the power tong (not shown in FIG. 6B).

Figure 7:
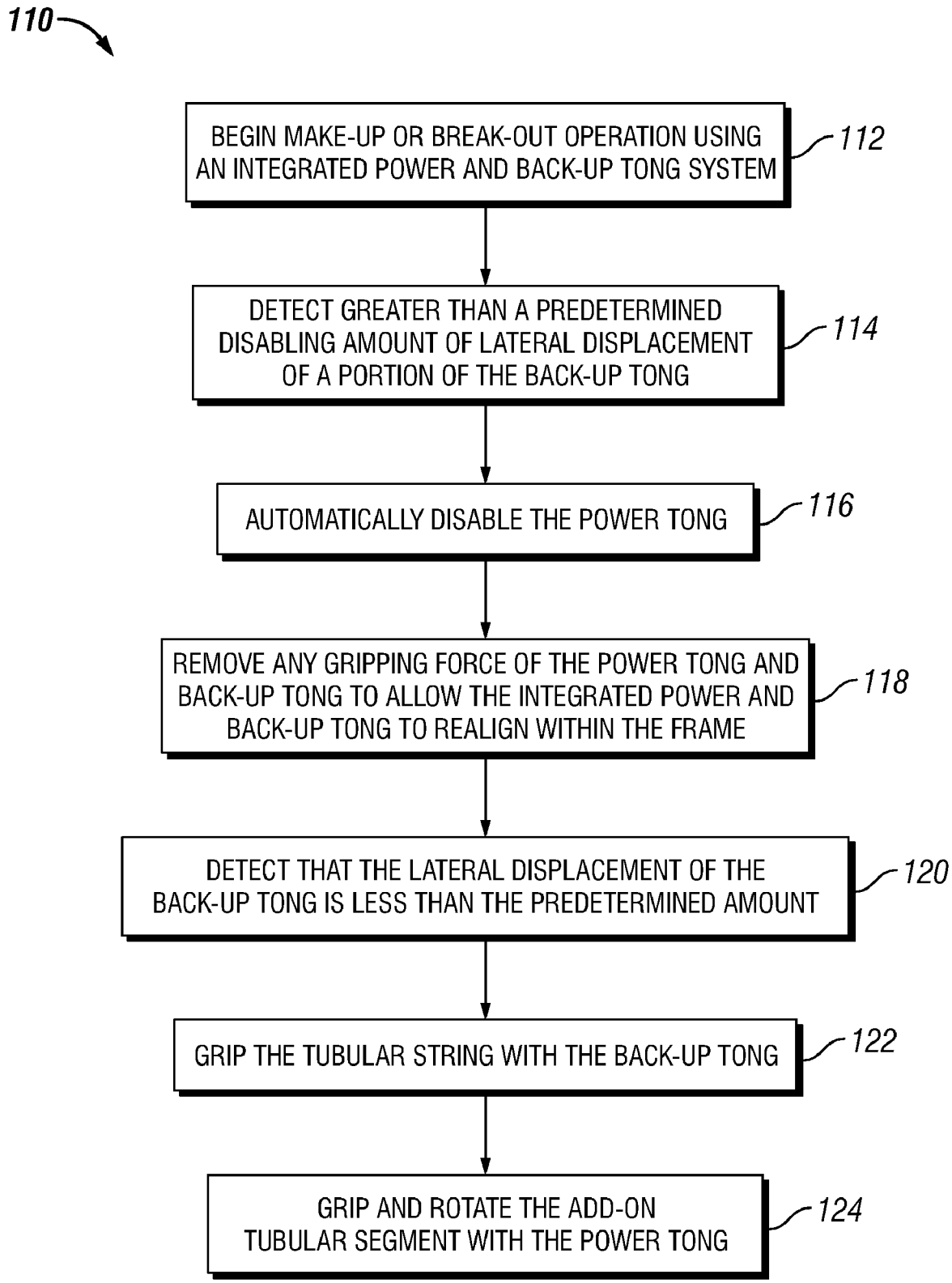
FIG. 7 is a flowchart of an exemplary method to make-up or break-out a tubular connection using an integrated tong system.

FIG. 7 is a flowchart of an exemplary method 110 of the present invention. In step 112, an integrated tong is used to begin a make-up or break-out operation involving a threaded connection between adjacent tubular segments. In step 114, an amount of lateral displacement of a portion of the back-up tong is sensed as being greater than a predetermined threshold amount of allowed lateral displacement. This threshold amount of lateral displacement is generally indicative of the back-up tong slipping relative to the gripped tubular string. In response to sensing lateral displacement greater than the predetermined threshold amount, the power tong is automatically disabled in step 116. More specifically, and referring to the appended drawings illustrating one embodiment of a device to implement the method, specifically FIG. 6B, the displacement of the back-up tong causes a corresponding displacement of the element of the cam actuator rod within the bore of the chamber to cause one or the other of the cam surfaces on the cam to engage and displace the follower and the valve stem generally radially away from the cam actuator rod to open a valve and relieve hydraulic pressure to disable the power tong. Any gripping force of the back-up tong can be removed in step 118 to allow the power tong and back-up tong components to realign within the frame or other stationary structure relative to the tong. In one embodiment before continuing with the make-up or break-out operation, the lateral displacement of the back-up tong will be sensed as being less than the predetermined threshold amount of lateral displacement, as set out in step 120. In step 122, the back-up tong grips the tubular string, and in step 124 the power tong grips and rotates an add-on tubular segment (in a make-up operation) or the segment to be removed (in a break-out operation).

While the methods of the present invention may be implemented by directing individual signals to individual valves or through local analog controller, the methods may also be partially or completely controlled by a digital computer. In this manner, the hydraulic bypass valve 50 could be electronically controlled and movement of the cam actuator rod 68 could produce an electronic signal. For example, the cam actuator rod 68 may have conductive and nonconductive regions that can be sensed by a proximity sensor positioned adjacent the rod. The proximity sensor signal may then be communicated to a computer system executing a process control application that initiates control over the valve 50 and/or other components of the apparatus in accordance with the disclosed methods.

Figure 8:
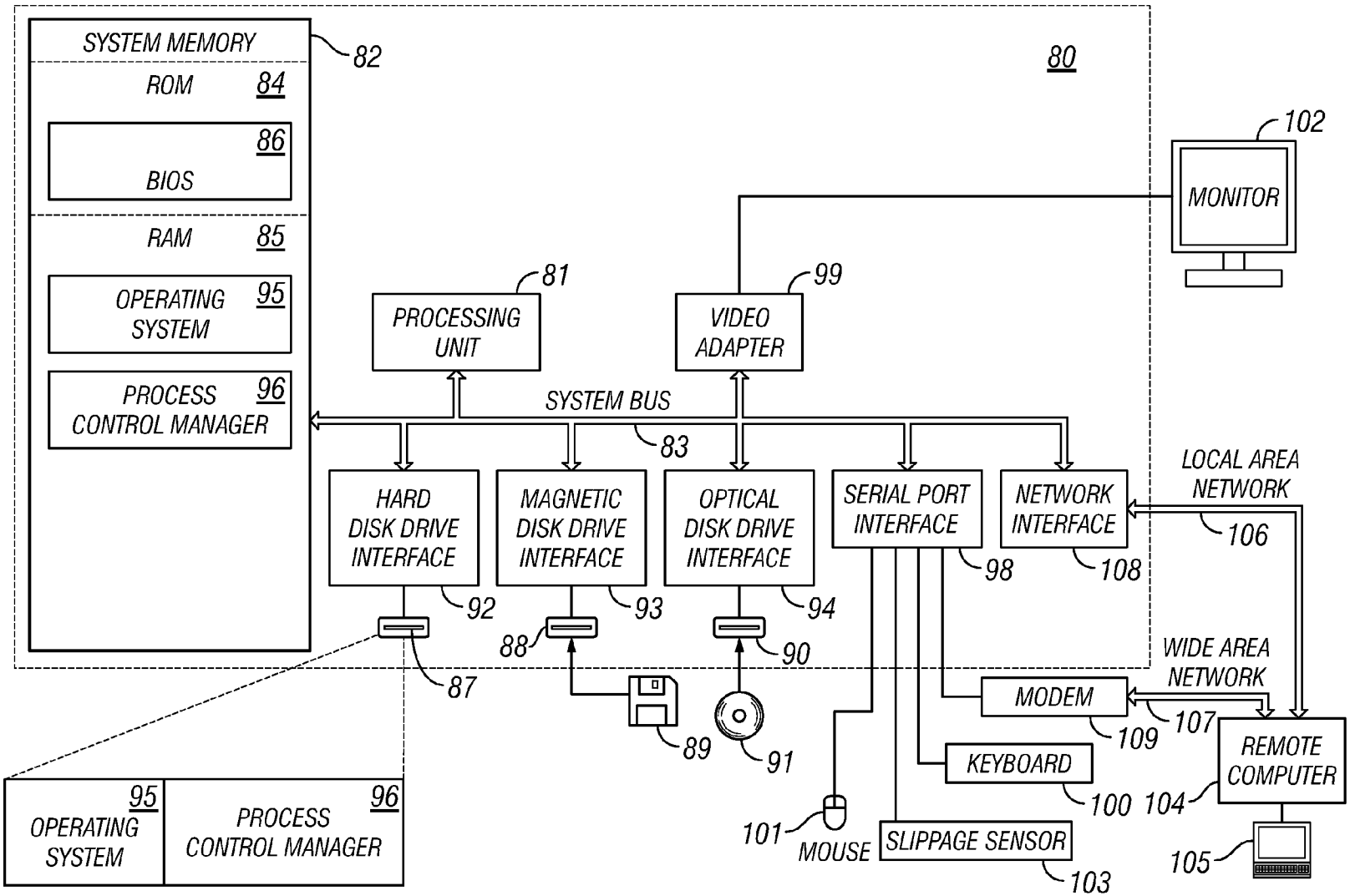
FIG. 8 is a schematic diagram of a computer system that is capable of controlling the methods of the present invention.

It should be understood that the methods of the present invention may be implemented without the use of a computer or microprocessor, but may be adapted for use with these systems. For example, but not by way of limitation, FIG. 8 is a schematic diagram of a computer system 80 that is capable of implementing or facilitating the methods of the present invention. The system 80 may be a general-purpose computing device in the form of a conventional personal computer 80. Generally, a personal computer 80 includes a processing unit 81, a system memory 82, and a system bus 83 that couples various system components including the system memory 82 to processing unit 81. System bus 83 may be any of several types of bus structures including a memory bus or memory controller, a peripheral bus, and a local bus using any of a variety of bus architectures. The system memory includes a read-only memory (ROM) 84 and random-access memory (RAM) 85. A basic input/output system (BIOS) 86, containing the basic routines that help to transfer information between elements within personal computer 80, such as during start-up, is stored in ROM 84.

Computer 80 further includes a hard disk drive 87 to read from and write to a hard disk 87, a magnetic disk drive 88 to read from or write to a removable magnetic disk 89, and an optical disk drive 90 to read from or write to a removable optical disk 91 such as a CD-ROM or other optical media. Hard disk drive 87, magnetic disk drive 88, and optical disk drive 90 are connected to system bus 83 by a hard disk drive interface 92, a magnetic disk drive interface 93, and an optical disk drive interface 94, respectively. Although the exemplary environment described herein employs a hard disk 87, a removable magnetic disk 89, and a removable optical disk 91, it should be appreciated by those skilled in the art that other types of computer readable media which can store data that is accessible by a computer, such as magnetic cassettes, flash memory cards, digital video disks, Bernoulli cartridges, RAMs, ROMs, and the like, may also be used in the exemplary operating environment. The drives and their associated computer readable media provide nonvolatile storage of computer-executable instructions, data structures, program modules, and other data for computer 80. For example, the operating system 95 and application programs, such as a process control manager 96, may be stored in the RAM 85 and/or hard disk 87 of the computer 80.

A user may enter commands and information, such as a predetermined threshold amount of slippage to trigger deactiviation of the power tong, into the system memory 82 of the computer 80 through input devices, such as a keyboard 100 and a pointing device, such as a mouse 101, and a display device 102 that may be connected to system bus 83. The system may also include a video adapter 99. The primary input device, the slippage sensor 103, along with other input devices, may be connected to processing unit 81 through a serial port interface 98 that is coupled to the system bus 83, but input devices may be connected by other interfaces, such as a parallel port, a universal serial bus (USB), or the like. The processing unit 81 may compare the predetermined threshold amount of slippage or displacement entered into the system memory 82 with the monitored amount of displacement being continuously or intermittently fed into the processing unit 81 by an analog position indicator (not shown) so that the processing unit can generate an interruption in an electrical and/or optical pathway, for example, in response to a received digital and/or analog signal exceeding the predetermined threshold amount of slippage or displacement entered by the user.

The computer 80 may operate in a networked environment using logical connections to one or more remote computers 104. Remote computer 104 may be another personal computer, a server, a client, a router, a network PC, a peer device, a mainframe, a personal digital assistant, an Internet-connected mobile telephone or other common network node. While a remote computer 104 typically includes many or all of the elements described above relative to the computer 80, only a display device 105 has been illustrated in the figure. The logical connections depicted in the figure include a local area network (LAN) 106 and a wide area network (WAN) 107. Such networking environments are commonplace in offices, enterprise-wide computer networks, intranets, and the Internet.

When used in a LAN networking environment, the computer 80 is often connected to the local area network 106 through a network interface or adapter 108. When used in a WAN networking environment, the computer 80 typically includes a modem 109 or other means to establish high-speed communications over WAN 107, such as the Internet. A modem 109, which may be internal or external, is connected to system bus 83 via serial port interface 98. In a networked environment, program modules depicted relative to personal computer 80, or portions thereof, may be stored in the remote memory storage device 105. It will be appreciated that the network connections shown are exemplary and other means of establishing a communications link between the computers may be used. A number of program modules may be stored on hard disk 87, magnetic disk 89, optical disk 91, ROM 84, or RAM 85, including an operating system 95 and fragment manager 96.

The described example of a computer system does not imply architectural limitations. For example, those skilled in the art will appreciate that the present invention may be implemented in other computer system configurations, including multiprocessor systems, network personal computers, minicomputers, mainframe computers, and the like. The invention may also be practiced in distributed computing environments, where tasks are performed by remote processing devices that are linked through a communications network. In a distributed computing environment, program modules may be located in both local and remote memory storage devices.

The term "power tong," as used in the claims and specification herein shall be considered as indicating an apparatus to grip and axially rotate a first tubular segment to threadably connect the first tubular segment to a second tubular segment. The term "back-up tong," as used in the claims and specification herein, shall be considered as indicating an apparatus adapted to grip the second tubular segment so as to impart to the second tubular segment a resistance to axial rotation with the first tubular segment as the threaded connection is being made-up.

The term "impair" as used in relation to the flow from the fluid line to the power tong, and as used in the claims and specification herein, shall be considered as including reducing pressure, redirecting flow, limiting pressure or flow, blocking flow, either partially or fully, relieving pressure, or a combination of one or more of these, or any other change that curtails the capacity of the fluid line to deliver power fluid to the power tong to enable its activation or continued operation.

The term "automatically," as used herein shall refer to being achieved via a machine or self-activating mechanism, and not by human intervention, e.g., after visually observing an event.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer,"

"optionally," "may," and similar terms are used to indicate that an item, condition or step being referred to is an optional (not required) feature of the invention.

What is claimed is:

1. A method of making up or breaking out a threaded connection between a first tubular segment and a second tubular segment, comprising:

providing a power tong to grip and rotate the first tubular segment and a back-up tong to grip the second tubular segment;

gripping and rotating the first tubular segment with the power tong while gripping the second tubular segment with the back-up tong to threadably make-up a connection therebetween;

sensing a lateral displacement of at least a portion of at least one of the power tong and the back-up tong; and automatically disabling operation of the power tong in response to sensing greater than a predetermined threshold amount of displacement of the portion of the at least one of the power tong and the back-up tong.

2. The method of claim 1, wherein the predetermined threshold amount of displacement is less than the amount of displacement that would allow the back-up tong to contact a frame supporting the power tong and back-up tong.

3. The method of claim 2, further comprising:

releasing the grip of the power tong from the first tubular segment;

releasing the grip of the back-up tong from the second tubular segment; and allowing the power tong and back-up tong to realign relative to the frame.

4. The method of claim 3, wherein after the power tong and back-up tong realign relative to the frame, then the method further comprises:

gripping the second tubular segment with the back-up tong; and then gripping and rotating the first tubular segment with the power tong.

5. The method of claim 4, further comprising:

monitoring displacement of the back-up tong.

6. The method of claim 4, further comprising:

enabling the power tong and the back-up tong in response to sensing that the displacement of the portion of the back-up tong is less than the predetermined amount.

7. The method of claim 4, further comprising:

enabling the power tong and the back-up tong in response to sensing that the displacement of the portion of at least one of the power tong and the back-up tong is less than a predetermined re-enabling amount that is less than the predetermined threshold amount.

8. The method of claim 2 further comprising the steps of coupling a safety line at a first end to the frame and coupling the safety line at a second end to the back-up tong;

wherein the safety line is coupled to become sufficiently taut to limit the movement of the back-up tong away from the frame upon slippage of the grip of the back-up tong on the second tubular segment.

9. The method of claim 1, wherein the step of automatically disabling operation of the power tong comprises relieving pressure in a fluid line that powers a motor to rotate the jaws of the power tong.

10. The method of claim 9, further comprising:

disengaging the power tong jaws from the first tubular segment.

11. The method of claim 10, wherein the engagement of the power tong jaws with the first tubular segment and the rotation of the power tong jaws are sequentially enabled by activation of a single mechanism.

12. The method of claim 11, wherein the step of disabling rotation of the power tong jaws also serves to disable engagement of the power tong jaws.

13. The method of claim 1, wherein the lateral displacement of the back-up tong is identified by a sensor selected from the group consisting of a mechanical sensor, an electronic sensor, an electromagnetic sensor, a hydraulic sensor, a pneumatic sensor, an optical sensor, and a combination thereof.

14. The method of claim 1, wherein the portion of the back-up tong wherein displacement is sensed is at a portion distal of a tubular gripping portion of the back-up tong.

15. The method of claim 1 wherein the step of detecting the displacement of at least a portion of at least one of the power tong and the back-up tong comprises:

coupling a first end of a sensor to at least one of the power tong and the back-up tong and a second end of the sensor to a frame supporting the power tong and the back-up tong.

16. The method of claim 15 further comprising:

providing a joint intermediate the sensor and the back-up tong to accommodate displacement of the back-up tong into alignment with a tubular string.

17. The method of claim 1, further comprising:

realigning the power tong and back-up tong to realign relative to the frame.

18. An apparatus, comprising:

a power tong;

a back-up tong;

a fluid line coupled to the power tong to provide a sufficient amount of fluid pressure to operate the power tong;

a sensor disposed to sense lateral displacement of a portion of at least one of the power tong and the back-up tong; and a valve disposed in fluid communication with the fluid line and operatively coupled to the sensor to impair flow from the fluid line to the power tong in response to sensing greater than a predetermined displacement of the portion of at least one of the power tong and the back-up tong.

19. The apparatus of claim 18, wherein the impairment of the flow from the fluid line to the power tong is automatic.

20. The apparatus of claim 19, wherein the sensor includes a mechanical coupling having a first end secured to the back-up tong and a second end secured to a frame supporting the power tong and the back-up tong.

21. The apparatus of claim 20, wherein the sensor comprises a joint to accommodate displacement of the back-up tong into alignment with a tubular string without operating the valve.

22. The apparatus of claim 21, wherein the sensor comprises a spherical joint to accommodate three dimensional displacement of the back-up tong.

23. The apparatus of claim 19, wherein the sensor comprises a sensor of a type selected from mechanical, electronic, electromechanical, electromagnetic, pressure, pneumatic, optical, and combinations thereof.

24. The apparatus of claim 18, wherein the engagement of one or more power tong jaws and the operation of the one or more power tong jaws are integrated such that disabling operation of the one or more power tong jaws also serves to disable engagement of the one or more power tong jaws.

25. The apparatus of claim 18, wherein the predetermined displacement is less than the amount of displacement that would allow the back-up tong to contact a frame supporting the integrated power and back-up tong.

26. The apparatus of claim 18 further comprising a safety line coupled at a first end to the frame and at a second end to the distal end of the back-up tong to limit the movement of the back-up tong away from the frame.

27. An apparatus, comprising:

a power tong and back-up tong supported by a frame and including a fluid line coupled to the power tong to provide a sufficient amount of fluid pressure to operate the power tong;

a slippage sensor coupled through a tether to the back-up tong; and a valve having an open position and a closed position, and disposed in communication with the fluid line and operatively coupled to the slippage sensor to impair flow to the power tong in response to a displacement of the back-up tong producing a disabling amount of tension in the tether.

28. The apparatus of claim 27 wherein the tether is coupled to a fuse element of the slippage sensor to trigger the fuse element by translation of a disabling amount of tension to the fuse element.

29. A method of making up or breaking out a threaded connection between a first tubular segment and a second tubular segment, comprising:

providing a power tong to grip and rotate a first tubular segment and a back-up tong to grip a second tubular segment;

gripping and rotating the first tubular segment with the power tong while gripping the second tubular segment with the back-up tong to threadably make-up a connection therebetween;

sensing the displacement of at least a portion of the back-up tong using a tether; and automatically disabling operation of the power tong in response to sensing a disabling amount of displacement of the portion of the back-up tong.

30. The method of claim 29 wherein the sensing step comprises sensing the displacement of at least a portion of the back-up tong via a fuse element coupled to the portion.

31. An apparatus to make-up or break-out a threaded connection, comprising:

a power tong to grip and rotate a tubular segment; and a sensor to sense lateral displacement of at least a portion of the power tong;

wherein the sensor disables the power tong in response to sensing a lateral displacement exceeding a predetermined amount of displacement.

32. A method of making up or breaking out a threaded connection between a first tubular segment and a second tubular segment, comprising:

providing a power tong to grip and rotate a first tubular segment and a back-up tong to grip a second tubular segment;

gripping and rotating the first tubular segment with the power tong while gripping the second tubular segment with the back-up tong to threadably make-up a connection therebetween;

sensing the displacement of at least a portion of at least one of the power tong and the back-up tong using a tether; and automatically disabling operation of the power tong in response to sensing a disabling amount of displacement of the portion of the back-up tong.

33. The method of claim 32, wherein the disabling amount of displacement is less than the amount of displacement that would allow the back-up tong to contact a frame supporting the power tong and back-up tong.

34. The method of claim 33, further comprising:

releasing the grip of the power tong from the first tubular segment;

releasing the grip of the back-up tong from the second tubular segment; and allowing the power tong and back-up tong to realign relative to the frame.

35. The method of claim 34, wherein after the power tong and back-up tong realign relative to the frame, then the method further comprises:

gripping the second tubular segment with the back-up tong; and then gripping and rotating the first tubular segment with the power tong.

36. The method of claim 35, further comprising:

monitoring displacement of the back-up tong.

37. The method of claim 35, further comprising:

enabling the power tong and the back-up tong in response to sensing that the displacement of the portion of the back-up tong is less than the predetermined amount.

38. The method of claim 35, further comprising:

enabling the power tong and the back-up tong in response to sensing that the displacement of the portion of the back-up tong is less than a predetermined re-enabling amount that is less than the disabling amount of displacement.

39. The method of claim 33 further comprising the steps of coupling a safety line at a first end to the frame and coupling the safety line at a second end to the back-up tong;

wherein the safety line is coupled to become sufficiently taut to limit the movement of the back-up tong away from the frame upon slippage of the grip of the back-up tong on the second tubular segment.

40. The method of claim 32, wherein the step of automatically disabling operation of the power tong comprises relieving pressure in a fluid line that powers a motor to rotate the jaws of the power tong.

41. The method of claim 40, further comprising:

disengaging the power tong jaws from the first tubular segment.

42. The method of claim 41, wherein the engagement of the power tong jaws with the first tubular segment and the rotation of the power tong jaws are sequentially enabled by activation of a single mechanism.

43. The method of claim 42, wherein the step of disabling rotation of the power tong jaws also serves to disable engagement of the power tong jaws.

44. The method of claim 32, wherein the disabling amount of displacement of the portion of the back-up tong is identified by a sensor selected from the group consisting of a mechanical sensor, an electronic sensor, an electromagnetic sensor, a hydraulic sensor, a pneumatic sensor, an optical sensor, and a combination thereof.

45. The method of claim 32, wherein the portion of the back-up tong wherein the disabling displacement is sensed is at a portion distal of a tubular gripping portion of the back-up tong.

46. The method of claim 32 wherein the step of detecting the displacement of at least a portion of at least one of the power tong and the back-up tong comprises:

coupling a first end of a sensor to at least one of the power tong and the back-up tong and a second end of the sensor to a frame supporting the power tong and the back-up tong.

47. The method of claim 46 further comprising:

providing a joint intermediate the sensor and the back-up tong to accommodate displacement of the back-up tong into alignment with a tubular string.

48. The method of claim 32, further comprising:

realigning the power tong and back-up tong to realign relative to the frame.

49. An apparatus, comprising:

a power tong and back-up tong supported by a frame and including a fluid line coupled to the power tong to provide a sufficient amount of fluid pressure to operate the power tong;

a slippage sensor coupled through a tether to the back-up tong; and a valve having an open position and a closed position, and disposed in communication with the fluid line and operatively coupled to the slippage sensor to impair flow to the power tong in response to a displacement of at least one of the power tong and the back-up tong producing a disabling amount of tension in the tether.

50. The apparatus of claim 49, wherein the sensor includes a mechanical coupling having a first end secured to the back-up tong and a second end secured to a frame supporting the power tong and the back-up tong.

51. The apparatus of claim 50, wherein the sensor comprises a joint to accommodate displacement of the back-up tong into alignment with a tubular string without operating the valve.

52. The apparatus of claim 51, wherein the sensor comprises a spherical joint to accommodate three dimensional displacement of the back-up tong.

53. The apparatus of claim 50, wherein the slippage sensor comprises a sensor of a type selected from mechanical, electronic, electromechanical, electromagnetic, pressure, pneumatic, optical, and combinations thereof.

54. The apparatus of claim 49, wherein the engagement of one or more power tong jaws and the operation of the one or more power tong jaws are integrated such that disabling operation of the one or more power tong jaws also serves to disable engagement of the one or more power tong jaws.

55. The apparatus of claim 49, wherein the predetermined displacement is less than the amount of displacement that would allow the back-up tong to contact a frame supporting the integrated power and back-up tong.

56. The apparatus of claim 49 further comprising a safety line coupled at a first end to the frame and at a second end to the distal end of the back-up tong to limit the movement of the back-up tong away from the frame.

* * * * *